US005879179A

United States Patent [19]

Fukuda

[11] Patent Number: 5,879,179

[45] Date of Patent: Mar. 9, 1999

[54] WATERPROOF CONNECTOR

[75] Inventor: Masaru Fukuda, Shizuoka, Japan

[73] Assignee: Yazaki Corporation, Tokyo, Japan

[21] Appl. No.: 847,631

[22] Filed: Apr. 28, 1997

[30] Foreign Application Priority Data

Apr. 26, 1996 [JP] Japan ..... 8-107802

[51] Int. Cl.[6] ..... H01R 13/52

[52] U.S. Cl. ..... 439/271; 439/595

[58] Field of Search ..... 439/271, 272, 439/589, 595, 732, 744, 752

[56] References Cited

U.S. PATENT DOCUMENTS

| | | | |
|---|---|---|---|
| 5,336,101 | 8/1994 | Kasugai et al. | 439/272 |
| 5,484,301 | 1/1996 | Koumatsu et al. | 439/271 |
| 5,575,683 | 11/1996 | Saito et al. | 439/595 |
| 5,679,019 | 10/1997 | Sakai et al. | 439/271 |
| 5,713,761 | 2/1998 | Okagasu | 439/595 |

FOREIGN PATENT DOCUMENTS

| | | | |
|---|---|---|---|
| 7-142116 | 6/1995 | Japan | H01R 13/52 |

*Primary Examiner*—Neil Abrams
*Assistant Examiner*—Brian J. Biggi
*Attorney, Agent, or Firm*—Sughrue, Mion, Zinn, Macpeak & Seas, PLLC

[57] ABSTRACT

In a waterproof connector, relief portions are notched in an insertion-side end of a packing, and when the packing is fitted on an inner tubular portion of a male connector housing, support post portions of a lock arm, formed on the outer periphery of the inner tubular portion, pass through the relief portions, respectively. With this arrangement, the lock arm can be disposed closer to the front end of the male connector housing, and therefore the housing can be formed into a compact size in accordance with the minimum size of the inner tubular portion for receiving and holding connection terminals.

2 Claims, 6 Drawing Sheets

WATERPROOF CONNECTOR

BACKGROUND OF THE INVENTION

This invention relates to a waterproof connector suitably used, for example, for interconnecting wire harnesses in an automobile, and more particularly to an improved packing for forming a watertight seal between fitting portions of connector housings.

FIGS. 8 to 10 show the construction of a conventional waterproof connector.

The waterproof connector 1 shown in these Figures is disclosed in Japanese Patent Unexamined Publication No. Hei 7-142116, and is used for interconnecting wire harnesses in an automobile.

In this waterproof connector 1, a watertight seal between a male connector housing 2 and a female connector housing 3 is formed by a packing 4 interposed between the male and female connector housings 2 and 3.

The male and female connector housings 2 and 3 are molded of a synthetic resin having an excellent insulating property, and the packing 4 is molded of synthetic rubber or the like which is easily elastically deformable.

The male connector housing 2 includes an inner tubular portion 7 having terminal receiving chambers 6 for respectively receiving and holding connection terminals (not shown), an outer tubular portion 12 formed around the inner tubular portion 7 to form a fitting space 10 therebetween for receiving a generally-tubular, housing fitting portion 8 of the female connector housing 3, and a lock arm 17 which has a support post portion 14 (see FIG. 10) extending upright from the outer peripheral surface of the inner tubular portion 7, and an arm portion 15 extending from a distal end of the support post portion 14 in a direction of fitting and withdrawing of the two connector housings relative to each other (that is, in a direction (right-left direction in FIG. 10) of the axis of the inner tubular portion 7).

As shown in FIG. 8, the lock arm 17 is provided at the upper side of the inner tubular portion 7. As shown in FIG. 10, the arm portion 15 of this lock arm 17 is connected to the distal end of the support post portion 14 at its central portion in the direction of fitting and withdrawing of the two connector housings relative to each other, and when a rear end 15*a* of the arm portion 15 is depressed as indicated by arrow "a", the arm portion 15 is pivotally moved or turned about a fulcrum defined by a portion where the arm portion 15 is connected to the support post portion 14, so that a front end of the arm portion 15 is lifted as indicated by arrow "b".

The female connector housing 3 includes the generally-tubular, housing fitting portion 8 for being inserted into the fitting space 10, and has a retaining hole 8*a* which is retainingly engaged with an engagement projection 15*b*, formed on the front end of the arm portion 15, when the housing fitting portion 8 is inserted a predetermined amount into the fitting space 10. The retaining hole 8*a* is formed through an distal end portion of the housing fitting portion 8.

Although not shown in the drawings, terminal receiving chambers, corresponding respectively to those of the inner tubular portion 7, are formed in an inner end portion of the housing fitting portion 8.

The packing 4 is beforehand mounted on the outer periphery of the inner tubular portion 7, and closes a gap between the housing fitting portion 8 inserted in the fitting space 10, and the inner tubular portion 7, thereby forming a watertight seal between the fitting portions of the connector housings.

The packing 4 includes a tubular portion 19 fitted on the outer peripheral surface of the inner tubular portion 7 in intimate contact therewith, and retaining pawls 23 which extend radially outwardly from an insertion-side end 19*a* of the tubular portion 19, and are engaged respectively in packing retaining holes 21 formed in the outer tubular portion 12, the insertion-side end 19*a* being held against an inner end wall of the fitting space 10.

The pair of retaining pawls 23 are formed respectively on opposite (right and left) sides of the tubular portion 19 at the insertion-side end 19*a*.

A pair of protuberances 19*b* are formed on that portion of the outer peripheral surface of the tubular portion 19 disposed adjacent to a front end thereof, and these protuberances 19*b* enhance the intimate contact of the packing 4 with the housing fitting portion 8. Grooves 19*c* are formed in the inner peripheral surface of the tubular portion 19, and are engaged respectively with projections 25 formed on the outer peripheral surface of the inner tubular portion 7.

In the above waterproof connector 1, before the male and female connector housings 2 and 3 are fitted together, the packing 4 is fitted on the inner tubular portion 7 of the male connector housing 2, as shown in FIG. 9.

For fitting the packing 4, the packing 4 is first fitted on the distal end portion of the inner tubular portion 7, and then end surfaces 23*a* of the retaining pawls 23 are pushed by a jig or the like until the insertion-side end 19*a* of the tubular portion 19 is brought into engagement with the inner end wall of the fitting space 10, with the retaining pawls 23 received respectively in the packing retaining holes 21 in the male connector housing 2.

Thereafter, the housing fitting portion 8 of the female connector housing 3 is inserted into the fitting space 10, so that the gap between the housing fitting portion 8 and the inner tubular portion 7 is closed by the packing 4, thereby forming a watertight seal between the fitting portions.

When the housing fitting portion 8 is inserted a predetermined amount into the fitting space 10, the engagement projection 15*b* of the lock arm 17 is engaged in the retaining hole 8*a* formed in the female connector housing 3, thereby locking the two housings in a mutually-fitted condition, as shown in FIG. 10.

For releasing the mutual fitting between the housings, the rear end 15*a* of the lock arm 17 is depressed in the direction of arrow "a", so that the engagement projection 15*a* is disengaged from the retaining hole 8*a*, and in this condition the female connector housing 3 is withdrawn from the male connector housing 2.

The retaining pawls 23, formed on the tubular portion 19 at the insertion-side end 19*a*, are engaged respectively in the packing retaining holes 21 in the male connector housing 2, and therefore the packing 4 will not be disengaged from the male connector housing 2 during the operation of releasing the mutual fitting between the housings.

In the installation of wire harnesses in a vehicle, it is not easy to secure a sufficient space for mounting and receiving connectors and so on. Therefore, it is always important that the connector, used for connecting the wire harnesses together, should have a compact design.

In the above waterproof connector 1, however, the support post portion 14 of the lock arm 17 formed on the male connector housing 2 must be disposed rearwardly of the insertion-side end 19*a* of the packing 4 (that is, adjacent to the rear end of the male connector housing 2), as clearly seen from FIG. 10. The support post portion 14 need to have a predetermined thickness to have a required strength.

As a result, there has been encountered a problem that the axial length of the male connector housing 2 is increased, so that the size of the housing is increased.

SUMMARY OF THE INVENTION

It is therefore an object of this invention to overcome the above problems, and more specifically to provide a waterproof connector which is compact in size, and can be easily handled although a lock arm for locking the connector in a fitted condition relative to a mating connector is formed on an inner tubular portion of one of the connector housings.

The above object of the invention has been achieved by a waterproof connector comprising a connector housing which includes an inner tubular portion having terminal receiving chambers for respectively receiving connection terminals, and an outer tubular portion formed around the inner tubular portion to form a fitting space therebetween for receiving a generally-tubular, housing fitting portion of a mating connector housing, and a lock arm which has support post portions extending upright from an outer peripheral surface of the inner tubular portion, and an arm portion extending from distal ends of the support post portions in a direction of fitting and withdrawing of the two connector housings relative to each other; and a packing which is beforehand fittingly mounted on the outer periphery of the inner tubular portion, the packing including a tubular portion fitted on the outer peripheral surface of the inner tubular portion in intimate contact therewith to close a gap between the housing fitting portion inserted in the fitting space, and the inner tubular portion, and retaining pawls which extend radially outwardly from an insertion-side end of the tubular portion, and are engaged respectively in packing retaining holes formed in the outer tubular portion, the insertion-side end being held against an inner end wall of the fitting space;

characterized in that relief portions are notched in an insertion-side end of the packing; and when the packing is fitted on the inner tubular portion, the support post portions of the lock arm pass through the relief portions, respectively.

In the above waterproof connector, dimensions and shape of the relief portions are determined in accordance with the positions of formation of the support post portions of the lock arm and their cross-sectional shape so that the packing can be properly positioned when the support post portions of the lock arm are fitted respectively in the relief portions in the insertion-side end of the packing upon fitting the packing on the inner tubular portion.

With the above construction of the invention, the relief portions, which respectively pass the support post portions of the lock arm (formed on the outer periphery of the inner tubular portion) therethrough, are notched in the insertion-side end of the packing fitted on the inner tubular portion of the connector housing, and therefore the support post portions of the lock arm are disposed closer to the front end of the housing than the insertion-side end of the packing on the inner tubular portion.

The dimensions and shape of the relief portions are determined in accordance with the positions of formation of the support post portions of the lock arm and their cross-sectional shape, and therefore if the relief portions in the packing to be pushed into the connector housing-fitting space are not properly registered with the support post portions of the lock arm, respectively, the packing can not be pushed into the predetermined position, and therefore the improper fitting of the packing can be detected.

DETAILED DESCRIPTION OF THE INVENTION

One preferred embodiment of the present invention will now be described in detail with reference to the accompanying drawings.

Figure 1:
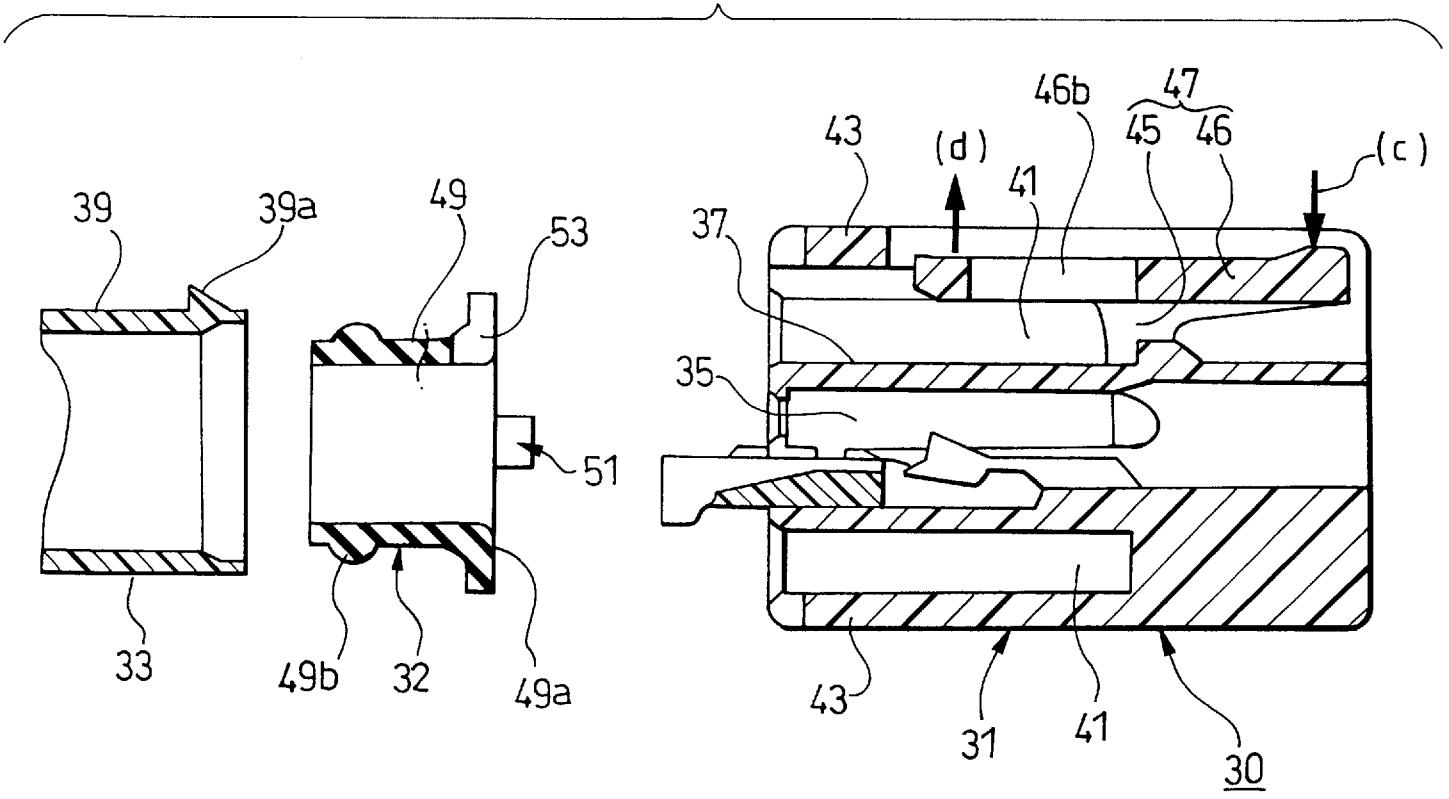
FIG. 1 is an exploded, vertical cross-sectional view showing the relation between a male connector housing and a packing in one preferred embodiment of a waterproof connector of the invention.
Figure 2:
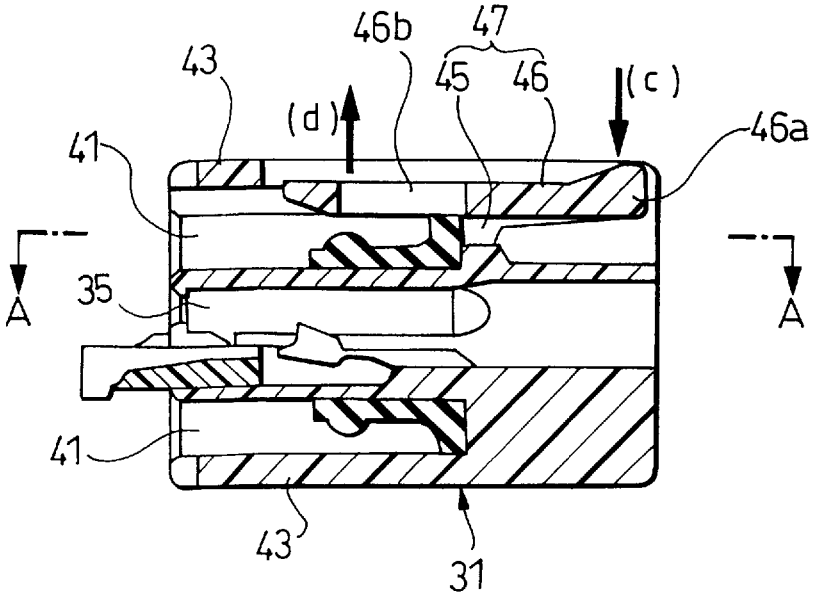
FIG. 2 is a vertical cross-sectional view showing a condition in which the packing is mounted on the male connector housing of the waterproof connector of FIG. 1.
Figure 3:
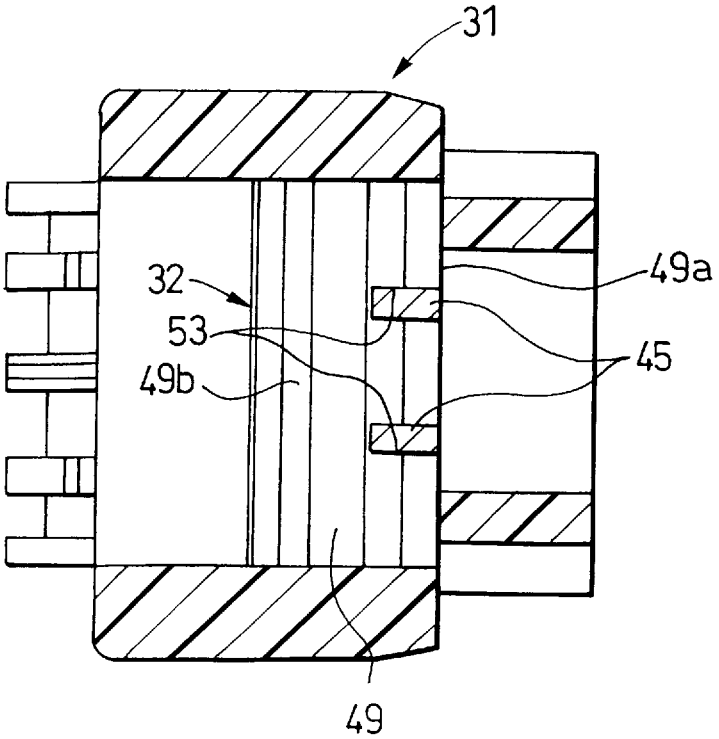
FIG. 3 is a cross-sectional view taken along the line A—A of FIG. 2.
Figure 4:
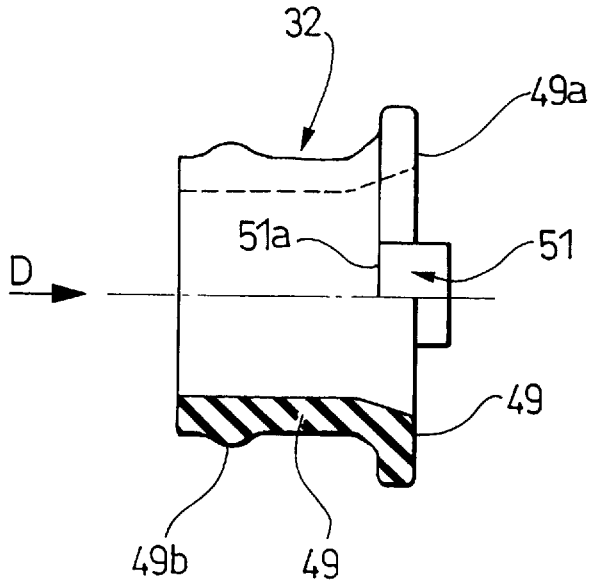
FIG. 4 is a partly cross-sectional, side-elevational view of the packing shown in FIG. 1.
Figure 5:
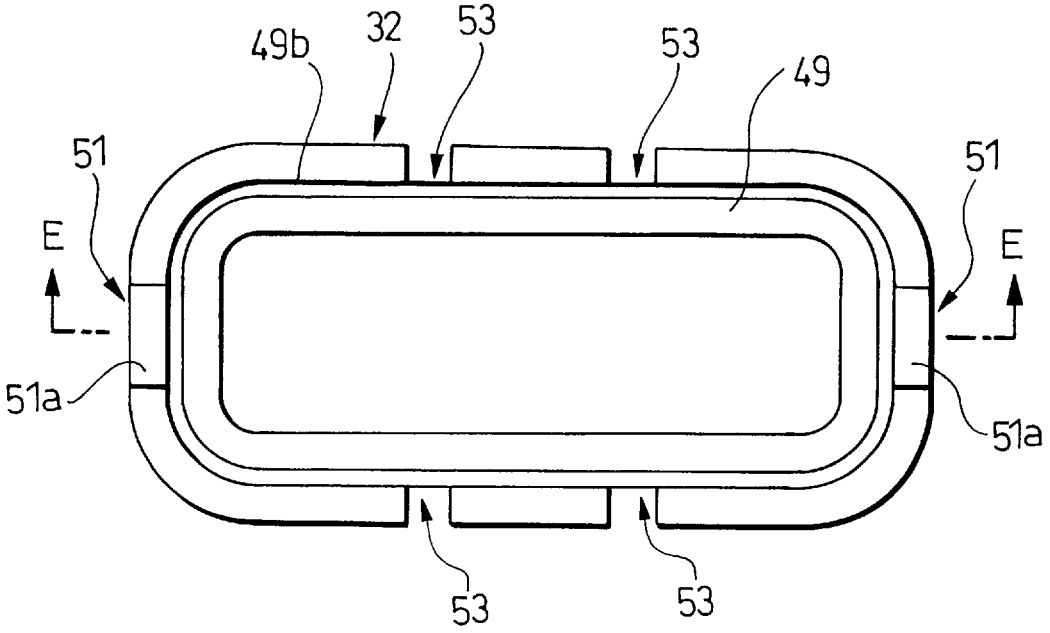
FIG. 5 is a view as seen from direction D of FIG. 4.
Figure 6:
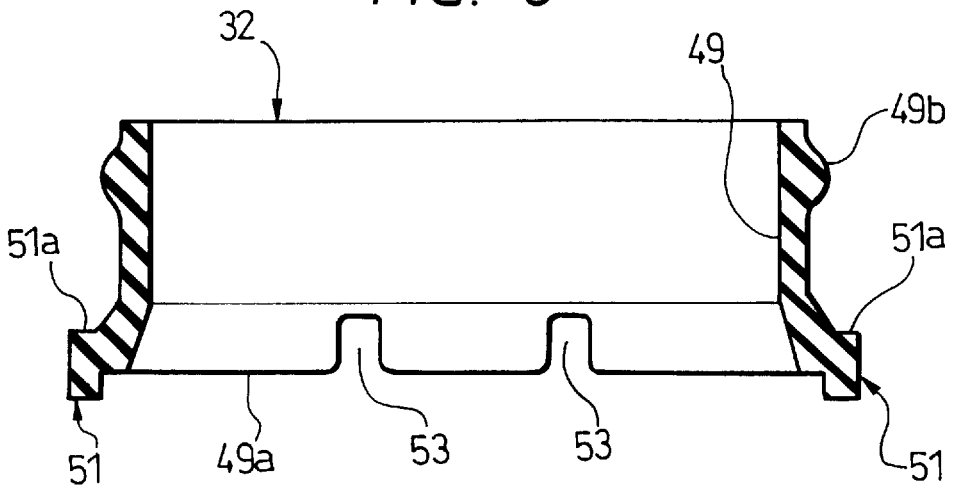
FIG. 6 is a cross-sectional view taken along the line E—E of FIG. 5.
Figure 7:
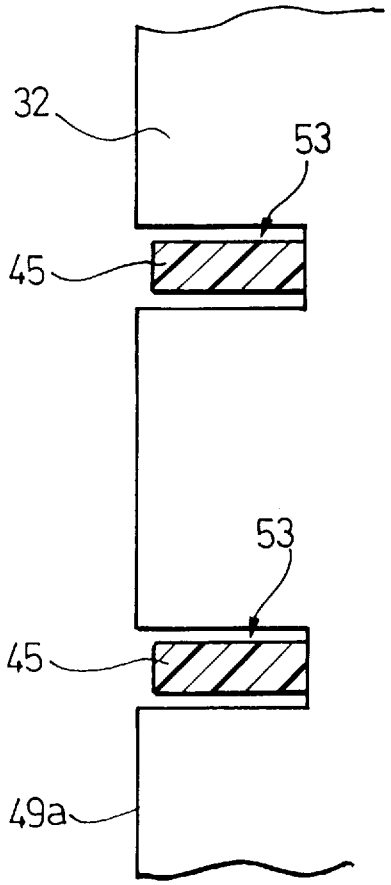
FIG. 7 is a cross-sectional view of an important portion in FIG. 2.

FIGS. 1 to 7 show a waterproof connector according to the present invention. FIG. 1 is an exploded, vertical cross-sectional view showing the relation between a male connector housing 31 and a packing 32 in the waterproof connector 30 of this embodiment, FIG. 2 is a vertical cross-sectional view showing a condition in which the packing 32 is mounted on the male connector housing 31, FIG. 3 is a cross-sectional view taken along the line A—A of FIG. 2, FIG. 4 is a partly cross-sectional, side-elevational view of the packing 32 in this embodiment, FIG. 5 is a view as seen from direction D of FIG. 4, FIG. 6 is a cross-sectional view taken along the line E—E of FIG. 5, and FIG. 7 is a cross-sectional view of an important portion in FIG. 2.

The waterproof connector 30 of this embodiment is used for interconnecting wire harnesses in an automobile, and as shown in FIG. 1, in this waterproof connector 30, a watertight seal between fitting portions of the male connector housing 31 and a female connector housing 33 is formed by the packing 32 interposed between the fitting portions of the male and female connector housings 31 and 33.

The male and female connector housings 31 and 33 are molded of a synthetic resin having an excellent insulating property, and the packing 32 is molded of synthetic rubber or the like which is easily elastically deformable.

The male connector housing 31 includes an inner tubular portion 37 having terminal receiving chambers 35 for respectively receiving connection terminals (not shown), and an outer tubular portion 43 formed around the inner tubular portion 37 to form a fitting space 41 therebetween for receiving a generally-tubular, housing fitting portion 39 of the female connector housing 33, and a lock arm 47 which has support post portions 45 extending upright from the outer peripheral surface of the inner tubular portion 37, and an arm portion 46 extending from distal ends of the support post portions 45 in a direction of fitting and withdrawing of the two connector housings relative to each other (that is, in a direction (right-left direction in FIG. 1) of the axis of the inner tubular portion 37).

As shown in FIG. 1, the lock arm 47 is provided at the upper side of the inner tubular portion 37. As shown in FIG. 2, the pair of support post portions 45 are spaced from each other in the direction of the width of the connector. As is clear from FIGS. 1 and 2, the arm portion 46 is in the form of a flat plate, and is connected to the distal ends of the pair of support post portion 45 at its central portion in the direction of fitting and withdrawing of the two connector housings relative to each other, and when a rear end 46*a* of the arm portion 46 is depressed as indicated by arrow "c" as shown in FIG. 2, the arm portion 46 is pivotally moved or turned about a fulcrum defined by a portion where the arm portion 46 is connected to the support post portions 45, so that a front end of the arm portion 46 is lifted as indicated by arrow "d".

The female connector housing 33 includes the generally-tubular, housing fitting portion 39 for being inserted into the fitting space 41, and has an engagement projection 39*a* (see FIG. 1) which is engaged in a retaining hole 46*b* (see FIG. 2), formed in a front end portion of the arm portion 46, when the housing fitting portion 39 is inserted a predetermined amount into the fitting space 41. The retaining projection 39*a* is formed on an outer peripheral surface of the housing fitting portion 39.

Although not shown in the drawings, terminal receiving chambers, corresponding respectively to those of the inner tubular portion 37, are formed in an inner end portion of the housing fitting portion 39.

Figure 8:
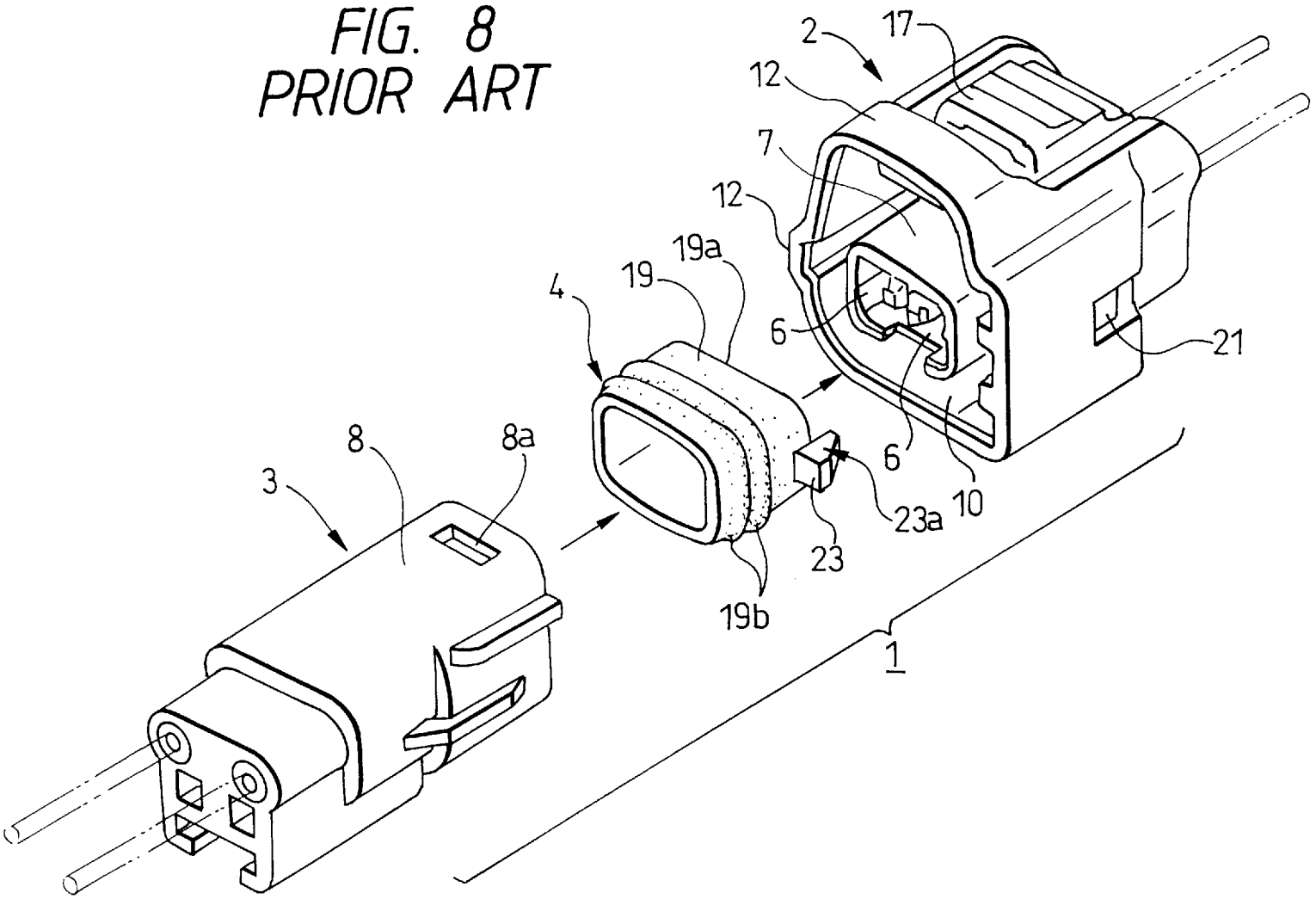
FIG. 8 PRIOR ART
FIG. 8 is an exploded, perspective view of a conventional waterproof connector.
Figure 9:
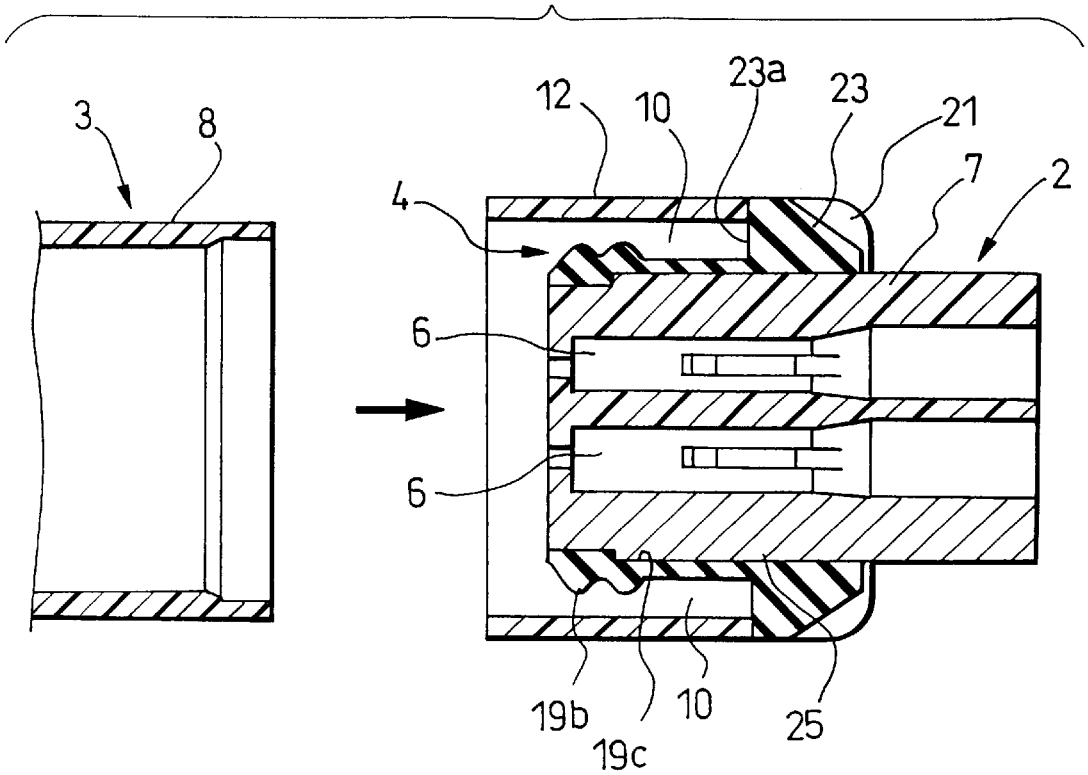
FIG. 9 PRIOR ART
FIG. 9 is a cross-sectional view showing a condition in which a packing is mounted on a male connector housing of the waterproof connector of FIG. 8.
Figure 10:
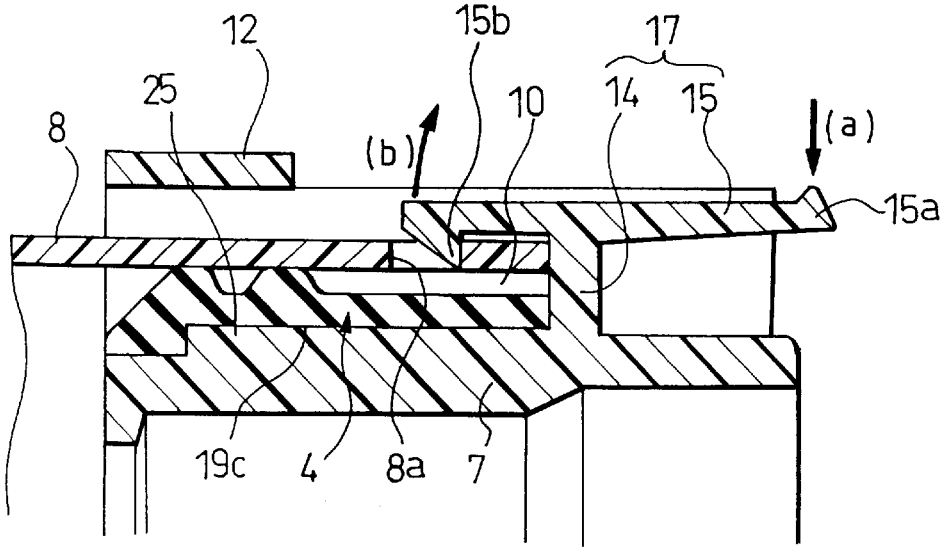
FIG. 10 PRIOR ART
FIG. 10 is a cross-sectional view showing the construction of a lock arm for locking two connector housings of the waterproof connector of FIG. 8 in a mutually-fitted condition.

The packing 32 is beforehand fittingly mounted on the outer periphery of the inner tubular portion 37, and closes a gap between the housing fitting portion 39, inserted in the fitting space 41, and the inner tubular portion 37, thereby forming a watertight seal between the fitting portions of the connector housings. The packing 32 includes a tubular portion 49 fitted on the outer peripheral surface of the inner tubular portion 37 in intimate contact therewith, and retaining pawls 51 which extend radially outwardly from an insertion-side end 49*a* of the tubular portion 49, and are engaged respectively in packing retaining holes (which are not shown, but are similar to those formed in the conventional male connector housing 2 shown in FIG. 8) formed in the outer tubular portion 43, the insertion-side end 49*a* being held against an inner end wall of the fitting space 41.

As is clear from the FIGS. 4 to 6, the pair of retaining pawls 51 are formed respectively on opposite (right and left) sides of the tubular portion 49 at the insertion-side end 49*a*.

A protuberance 49*b* is formed on that portion of the outer peripheral surface of the tubular portion 49, disposed adjacent to a front end thereof, over an entire periphery thereof, and this protuberance 49*b* enhances the intimate contact of the packing 32 with the housing fitting portion 39.

Relief portions 53 are formed or notched in the insertion-side end 49*a* of the tubular portion 49, and when the packing 32 is fitted on the inner tubular portion 37, the support post portions 45 of the lock arm 47 pass through the relief portions 53, respectively.

The dimensions and shape of the relief portions 53 are determined in accordance with the positions of formation of the support post portions 45 of the lock arm 47 and their cross-sectional shape so that the packing 32 can be properly positioned when the support post portions 45 of the lock arm 47 are fitted respectively in the relief portions 53 in the insertion-side end 49*a* of the packing 32 upon fitting the packing 32 on the inner tubular portion 37.

In the waterproof connector 30, the packing 32 is fitted on the inner tubular portion 37 of the male connector housing 31 before the male and female connector housings 31 and 33 are fitted together.

For fitting the packing 32, the insertion-side end portion (right end portion in FIG. 2) of the packing 32 is first fitted on the distal end portion of the inner tubular portion 37, and then end surfaces 51*a* of the retaining pawls 51 is pushed by a jig or the like until the insertion-side end 49*a* of the tubular portion 49 is brought into engagement with the inner end wall of the fitting space 41, with the retaining pawls 51 received respectively in the packing retaining holes in the male connector housing 31.

Thereafter, the housing fitting portion 39 of the female connector housing 33 is inserted into the fitting space 41, so that the gap between the housing fitting portion 39 and the inner tubular portion 37 is closed by the packing 32, thereby forming a watertight seal between the fitting portions.

When the housing fitting portion 39 is inserted a predetermined amount into the fitting space 41, the engagement projection 39*a*, formed on the outer peripheral surface of the female connector housing 33, is engaged in the retaining hole 46*b* in the lock arm 47, thereby locking the two housings in a mutually-fitted condition.

For releasing the mutual fitting between the housings, the rear end 46*a* of the lock arm 46 is depressed in the direction of arrow "c" (see FIG. 2), so that the retaining hole 46*b* is disengaged from the engagement projection 39*a*, and in this condition the female connector housing 33 is withdrawn from the male connector housing 31.

The retaining pawls 51, formed on the tubular portion 49 at the insertion-side end 49*a*, are engaged respectively in the packing retaining holes in the male connector housing 31, and therefore the packing 32 will not be disengaged from the male connector housing 31 during the operation of releasing the mutual fitting between the housings.

In the waterproof connector 30 of this embodiment, when the packing 32 is properly mounted on the inner tubular portion 37, the support post portions 45 of the lock arm 47 are received respectively in the relief portions 53 formed in the insertion-side end 49*a* of the tubular portion 49 of the packing 32, as shown in FIG. 7.

Namely, the support post portions 45 of the lock arm 47 are disposed closer to the front end of the housing than the insertion-side end 49*a* of the packing 32 on the inner tubular portion 37, and the housing can be formed into a compact design in accordance with the minimum size of the inner tubular portion 37 for receiving and holding the connection terminals, and therefore there can be provided the waterproof connector 30 which is compact, and can be handled easily.

In this embodiment, during the fitting of the packing 32, if the relief portions 53 in the packing 32 to be pushed into the fitting space 41 are not accurately registered with the respective support post portions 45 of the lock arm 47, the support post portions 45 can not be fitted into the respective relief portions 53, so that the packing 32 can not be pushed into the predetermined position. Therefore, the overlooking of the improper fitting of the packing 32 is prevented, and it is possible to provide the connector of a high reliability in which the required waterproof performance is positively achieved by the properly-mounted packing 32.

The present invention is not limited to the waterproof connector 30 of the above embodiment, and various modifications can, of course, be made. For example, the thickness of the support post portions of the lock arm, as well as the number of the support post portions, can be changed, and the configuration of the relief portions in the packing can be changed.

In the waterproof connector of the present invention, the relief portions, which respectively pass the support post portions of the lock arm (formed on the outer periphery of the inner tubular portion) therethrough, are notched in the insertion-side end of the packing fitted on the inner tubular portion of the connector housing, and therefore the support post portions of the lock arm are disposed closer to the front end of the housing than the insertion-side end of the packing on the inner tubular portion.

Thus, the support post portions of the lock arm are disposed closer to the front end of the housing than the insertion-side end of the packing, and with this arrangement the housing can be formed into a compact design in accordance with the minimum size of the inner tubular portion for receiving and holding the connection terminals, and therefore there can be provided the waterproof connector which is compact in size, and can be easily handled.

The dimensions and shape of the relief portions are determined in accordance with the positions of formation of the support post portions of the lock arm and their cross-sectional shape, and therefore if the relief portions in the packing to be pushed into the connector housing-fitting space are not properly registered with the support post portions of the lock arm, respectively, the packing can not be pushed into the predetermined position, and therefore the improper fitting of the packing can be detected.

Therefore, the overlooking of the improper fitting of the packing is prevented, and there can be provided the waterproof connector of a high reliability in which the required waterproof performance is positively achieved by the properly-mounted packing.

Therefore, there can be provided the waterproof connector which is compact in size, and can be easily handled although the lock arm for locking the connector in a fitted condition relative to the mating connector is formed on the inner tubular portion of one of the connector housings.

What is claimed is:

1. A waterproof connector, comprising:

a connector housing which includes an inner tubular portion having terminal receiving chambers for respectively receiving connection terminals, an outer tubular portion disposed around said inner tubular portion to form a fitting space therebetween for receiving a generally-tubular, housing fitting portion of a mating connector housing, and a lock arm which has support post portions extending upright from an outer peripheral surface of said inner tubular portion, and an arm portion extending from distal ends of said support post portions in a direction of fitting and withdrawing of the two connector housings relative to each other; and a packing which is beforehand fittingly mounted on an outer periphery of said inner tubular portion, and closes a gap between said housing fitting portion inserted in said fitting space and said inner tubular portion, said packing including a tubular portion fitted on an outer peripheral surface of said inner tubular portion in intimate contact therewith, and retaining pawls which extend radially outwardly from an insertion-side end of said tubular portion, and are engaged respectively in packing retaining holes disposed in said outer tubular portion, said insertion-side end being held against an inner end wall of said fitting space;

wherein notched relief portions are disposed in an insertion-side end of said packing and when said packing is fitted on said inner tubular portion, said support post portions of said lock arm pass through said relief portions, respectively.

2. A waterproof connector according to claim 1, wherein dimensions and shape of said relief portions are determined in accordance with positions of formation of said support post portions of said lock arm and their cross-sectional shape so that said packing can be properly positioned when said support post portions of said lock arm are fitted respectively in said relief portions in the insertion-side end of said packing upon fitting said packing on said inner tubular portion.

* * * * *